US010599096B2

(12) United States Patent
Usui

(10) Patent No.: US 10,599,096 B2
(45) Date of Patent: Mar. 24, 2020

(54) IMAGE FORMING APPARATUS EQUIPPED WITH AIR COOLING MECHANISM FOR COOLING COMPONENTS (COOLED UNITS) DURING USE

(71) Applicant: KYOCERA Document Solutions Inc., Osaka (JP)

(72) Inventor: Shogo Usui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/271,800

(22) Filed: Feb. 9, 2019

(65) Prior Publication Data

US 2019/0250557 A1 Aug. 15, 2019

(30) Foreign Application Priority Data

Feb. 9, 2018 (JP) ..... 2018-022063

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS

2009/0202270 A1* 8/2009 Brown ..... G03G 15/0817 399/92

FOREIGN PATENT DOCUMENTS

JP 2010-085540 A 4/2010

* cited by examiner

*Primary Examiner* — Hoang X Ngo
(74) *Attorney, Agent, or Firm* — Hawaii Patent Services; Nathaniel K. Fedde; Kenton N. Fedde

(57) ABSTRACT

Provided is an image forming apparatus that cools a cooled unit with high cooling efficiency in the longitudinal direction with a simple structure. A connecting opening portion is provided in a boundary surface that partitions between a cooling duct and a parallel duct. A rectifying plate is shaped so as to deflect a flow of air from the right side to the left side in the vicinity of the connecting opening portion toward the lower side or toward the upper side. Low-temperature cooling air flow from the parallel duct into the cooling duct via the connecting opening portion. Alternatively, inside the cooling duct, high-temperature cooling air is removed through the connecting opening portion.

12 Claims, 11 Drawing Sheets

IMAGE FORMING APPARATUS EQUIPPED WITH AIR COOLING MECHANISM FOR COOLING COMPONENTS (COOLED UNITS) DURING USE

INCORPORATION BY REFERENCE

This application is based on and claims the benefit of priority from Japanese Patent Application No. 2018-022063 filed on Feb. 9, 2018, the contents of which are hereby incorporated by reference.

BACKGROUND

The present disclosure relates to an image forming apparatus that is equipped with an air cooling mechanism for cooling components (cooled units) during use.

In an image forming apparatus (laser printer), a toner pattern that is patterned corresponding to an exposed portion is formed on the surface of a cylindrical photosensitive drum. Then, this pattern is temporarily transferred to an intermediate transfer belt, and thereafter transferred to a medium (paper). In order for this, the photosensitive drum is provided with a charger for uniformly charging the photosensitive drum, and an exposing unit for forming an electrostatic latent image by exposing the surface of the photosensitive drum with a pattern corresponding to an image to be outputted and removing the charge of the exposed portion. A developing unit is provided for applying toner to the surface of the photosensitive drum to form a toner pattern corresponding to the electrostatic latent image on the surface of the photosensitive drum.

In the developing unit, a developer in which carriers (magnetic particles) and toner are mixed is used, and in a state in which the developer is supplied between the photosensitive drum and a developing roller, a toner pattern is formed on the surface of the photosensitive drum by rotating the photosensitive drum and the developing roller. Here, when the temperature of the developer is increased, there are cases in which the toner deteriorates (melts) or adheres to members other than the photosensitive drum. In such a case, problems may occur such as defects being generated in an image to be formed, the apparatus being damaged, or the like. On the other hand, in order to increase the processing speed, it is necessary to increase the rotation speed of the developing roller and the like, and in this case, the friction heat accompanying this increases. Moreover, in order to maintain the developer in an appropriate state, a stirring mechanism for stirring the developer is also provided, and frictional heat is also generated during this stirring.

Therefore, in the image forming apparatus, a mechanism for cooling the developing unit is provided. Here, since the photosensitive drum and the developing roller are formed to be elongated in the direction of the rotation axes thereof, the developing unit is formed to be elongated. In addition, in an image forming apparatus that forms a color image, four sets of photosensitive drums and developing units are usually provided, one for each color, and it is necessary to cool each of them. Therefore, in order to reduce the size and cost of the entire apparatus, the structure of the cooling mechanism is required to be simple. For this reason, as this cooling mechanism, a cooling mechanism having a configuration in which cooling air (gas) flows in the longitudinal direction of the developing unit is used.

In a typical technique, there is an image forming apparatus provided with such a cooling mechanism. In this image forming apparatus, the developing unit is detachable from the main body, and ducts for respectively causing cooling air to flow to the main body side and the developing unit side are provided. In this case, when the developing unit is mounted, the cooling air can flow smoothly from the duct on the main body side to the duct on the developing unit side, and cooling air can flow smoothly along the longitudinal direction of the developing unit. As a result, the cooling efficiency of the developing unit can be improved.

SUMMARY

The image forming apparatus according to the present disclosure is an image forming apparatus in which a cooling unit that is mounted on a lower portion of a cooled unit as a cooling target is used to cool the cooled unit by causing cooling air to flow along one direction. The cooling unit includes a cooling duct having an upper surface that comes in contact with the lower portion of the cooled unit along the one direction, and inside of which the cooling air flows along the one direction from one side toward another side. The cooling duct is provided with: an opening portion in an boundary surface that is a surface intersecting a surface contacting the upper surface in the cooling duct, and that connects on the upper surface side an inside portion of the cooling duct with an outside portion of the cooling duct. The cooling duct is provided with a rectifying plate that is located at a location along the one direction where the opening portion is formed, and that deflects the flow of the cooling air on an upper side inside the cooling duct in a vertical direction.

DETAILED DESCRIPTION

In the following, embodiments for carrying out the technique according to the present disclosure will be described with reference to the drawings. The image forming apparatus 1 of an embodiment includes a photosensitive drum, a developing unit, and the like similar to the image forming apparatus of the above-described typical technique.

Figure 1:
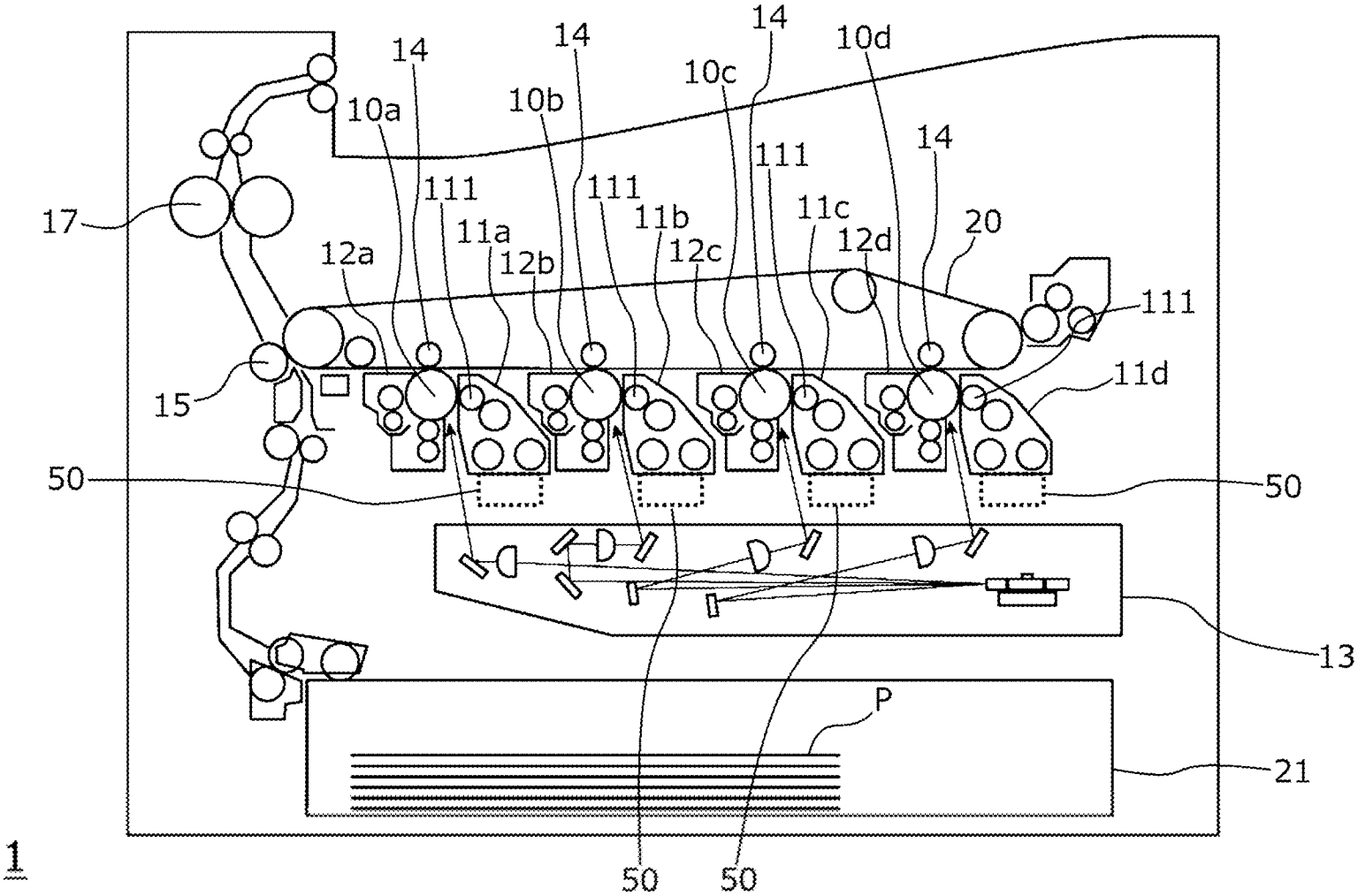
FIG. 1 is a cross-sectional view illustrating a structure of an image forming apparatus of an embodiment according to the present disclosure.

FIG. 1 is a cross-sectional view illustrating the structure of the image forming apparatus 1. Here, four photosensitive drums 10*a*, 10*b*, 10*c* and 10*d* that respectively correspond to color image data of C (cyan), M (magenta), Y (yellow), and K (black) are arranged in the left-right direction in the drawing. An intermediate transfer belt 20 is provided above these four photosensitive drums 10*a*, 10*b*, 10*c* and 10*d* so as to be in contact with them. In order for this, the photosensitive drums 10*a* to 10*d* are respectively provided with developing units 11*a*, 11*b*, 11*c*, and 11*d* that respectively apply a developer containing toner of each color described above. In addition, charging units 12*a*, 12*b*, 12*c*, and 12*d* are provided for respectively charging or cleaning the photosensitive drums 10*a*, 10*b*, 10*c*, and 10*d*.

Moreover, the charged states of the surfaces of the photosensitive drums 10*a* to 10*d* is performed so as to correspond to image patterns corresponding to C, M, Y, and K, respectively. Therefore, toner (toner particles) adheres to the surfaces of the photosensitive drums 10*a* to 10*d* in the image patterns by an electrostatic force. In order to form the charging patterns (latent images) on the photosensitive drums 10*a* to 10*d*, an exposing unit 13 performs exposure for each of the charged photosensitive drums 10*a* to 10 for each of the above-described C, M, Y and K. As a result, a latent image corresponding to the image pattern for each color is formed on each of the photosensitive drums 10*a* to 10*d*.

In the developing units 11*a* to 11*d*, toners corresponding to the respective colors of C, M, Y and K are used. The toner particles constituting each toner are independently used in each of the developing units 11*a* to 11*d* as a developer mixed with carrier particles (carriers) composed of a magnetic material. A magnetic field is applied to developing rollers 111 in the developing units 11*a* to 11*d*. Then, each developer is supplied between the photosensitive drums 10*a* to 10*d* to which the potential distribution is applied and the developing rollers 111. At this time, the carrier particles, which are magnetic material, adhere to the developing rollers 111, and the toner particles adhere to the surfaces of the photosensitive drums 10*a* to 10*d* according to the potential distribution applied to the photosensitive drums 10*a* to 10*d*. As a result, the image patterns composed of each toner type are formed on the photosensitive drums 10*a* to 10*d*.

The image pattern on each of the photosensitive drums 10*a* to 10*d* is transferred to the intermediate transfer belt 20 when the intermediate transfer belt 20 that is sandwiched between the primary transfer roller 14 provided on each of the photosensitive drums 10*a* to 10*d* and each of the photosensitive drums 10*a* to 10*d* moves.

On the other hand, a large number of sheets of paper P are stacked and accommodated in the paper cassette 21 provided below the image forming apparatus 1. The paper P is conveyed from the paper cassette 21 to a secondary transfer roller 15 side, and conveyed by being sandwiched between the intermediate transfer belt 20 to which the image patterns are primarily transferred and the secondary transfer roller 15. At this time, each image pattern is transferred onto the paper P. After that, the paper P is heated by a fixing roller 17 on the upper side, whereby each image pattern composed of each toner type is fixed on the paper P and is outputted (ejected).

Here, the cylindrical photosensitive drums 10*a* to 10*d* and the developing roller 111 rotate when operating, and the rotation axes (center axes) thereof are set to a direction perpendicular to the surface of the page in FIG. 1. Therefore, the longitudinal direction of the developing units 11*a* to 11*d* is also the direction perpendicular to the surface of the page. A cooling unit 50 is mounted to the lower portion (lower surface) of each of the developing units 11*a* to 11*d*. Like the developing units 11*a* to 11*d*, the cooling units 50 have a form that is elongated in the direction perpendicular to the surface of the page. The cooling units 50 cool each of the developing units 11*a* to 11*d* by allowing cooling air to flow along the longitudinal direction (direction perpendicular to the surface of the page).

Figure 2A:
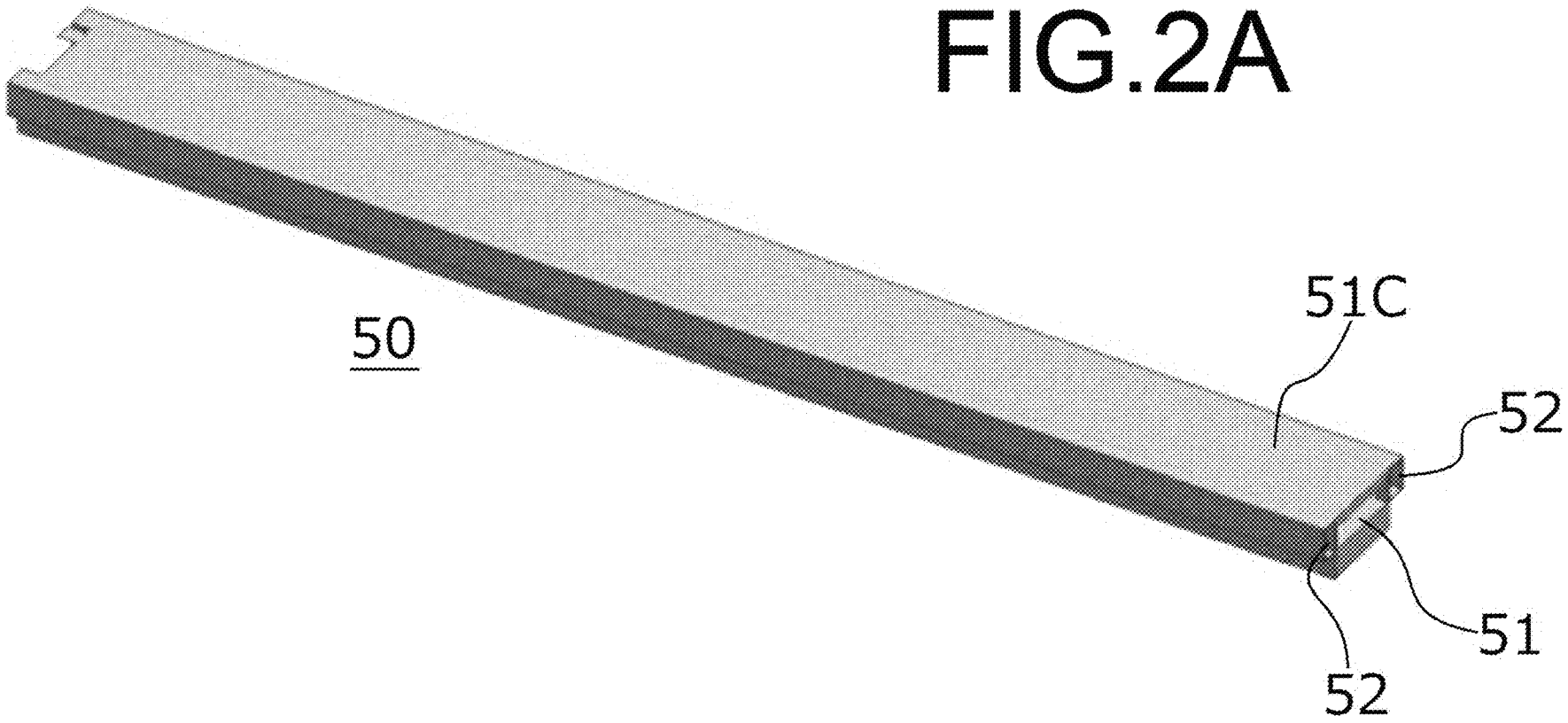
FIG. 2A is a perspective view of a cooling unit used in the image forming apparatus of an embodiment according to the present disclosure.

In the following, the structure of a cooling unit 50 will be described in detail. FIG. 2A is a perspective view illustrating an embodiment of a cooling unit 50. In this cooling unit 50, a cooling duct 51 having a rectangular cross section and provided with a flow passage extending along the longitudinal direction is provided. Cooling air flows inside the cooling duct 51 along the longitudinal direction of the cooling duct 51. On the other hand, parallel ducts 52 extending parallel to the cooling duct 51 are also provided on both sides of the cooling duct 51, respectively. Therefore, in the cooling duct 51 and the two parallel ducts 52, the cooling air can be made to flow in the same direction at the same time.

Figure 2B:
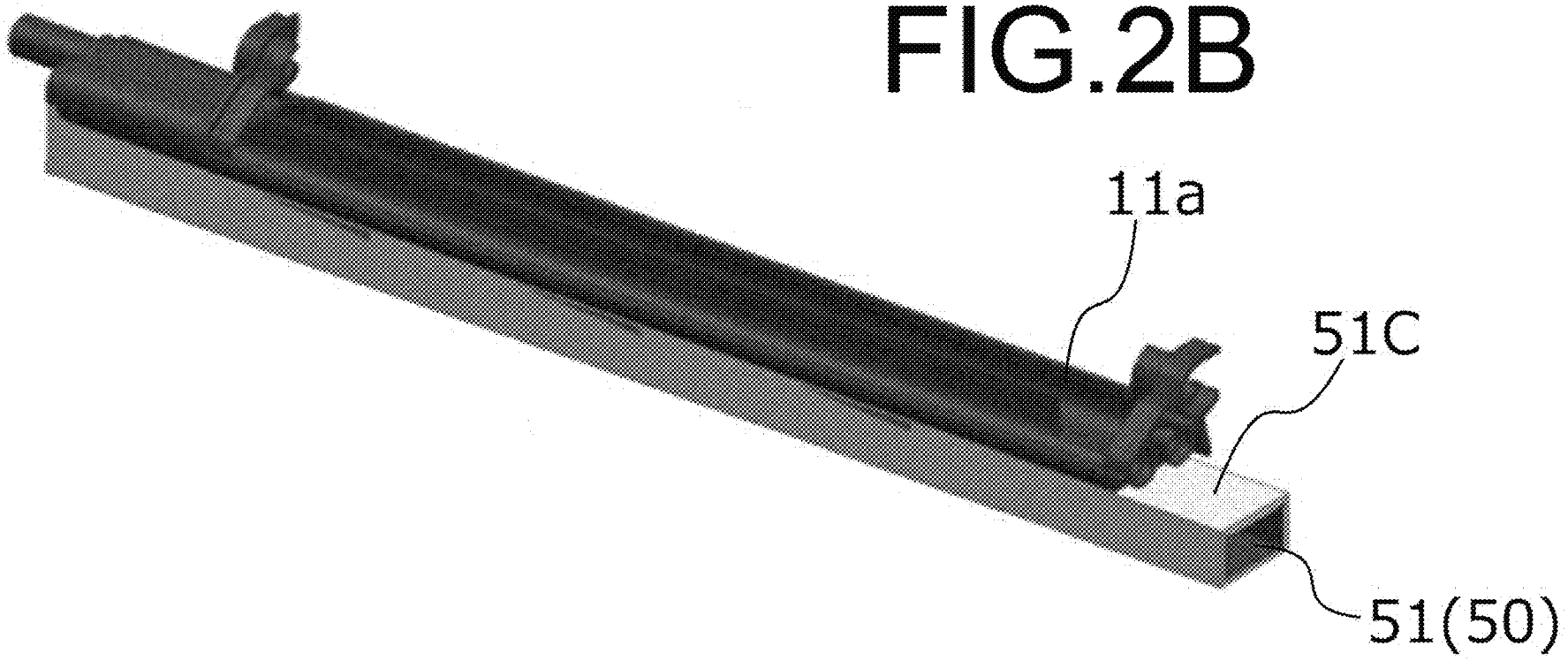
FIG. 2B is a perspective view illustrating a configuration when the cooling unit used in the image forming apparatus of an embodiment according to the present disclosure is attached to a developing unit.

However, of the above, only the cooling duct 51 directly contributes to the cooling of the developing unit 11*a*. FIG. 2B, corresponding to FIG. 2A, illustrates the relationship between the cooling duct 51 and the developing unit 11*a* when the cooling unit 50 is mounted on the developing unit 11*a*. Here, with respect to the developing unit 11*a*, only the configuration of the lower side (the cooling unit 50 side) is illustrated in a simplified manner, and a description of the parallel ducts 52 will be omitted. The upper surface 51C of the cooling duct 51 and the lower surface of the developing unit 11*a* make surface contact. Then, the heat that is generated in the developing unit 11*a* flows to the upper surface of the cooling duct 51 via the lower surface of the developing unit 11*a*, and is then transferred to the air flow (cooling air) flowing in the cooling duct 51. As a result, the heated cooling air is discharged from the outlet of the cooling duct 51 to the outside, whereby the developing unit 11*a* is cooled.

On the other hand, since the two parallel ducts 52 are provided outside the cooling duct 51 in FIG. 2B, they do not directly contribute to the cooling of the developing unit 11*a*. However, by providing these, it is possible to increase the cooling efficiency as compared with the case where only the cooling duct 51 is used. This point will be explained below.

Figure 3:
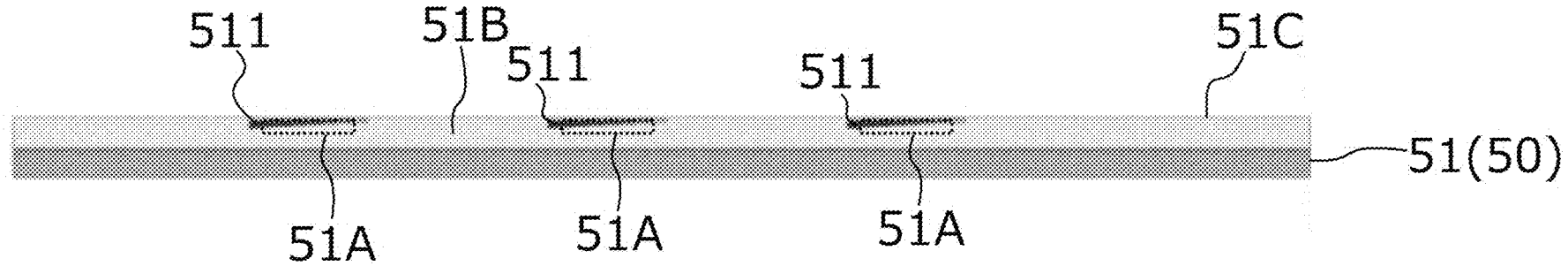
FIG. 3 is a perspective view along the longitudinal direction of the cooling unit used in the image forming apparatus of an embodiment according to the present disclosure.

FIG. 3 is a perspective view illustrating a configuration in the vicinity of the boundary between the cooling duct 51 and the parallel ducts 52 in the cooling unit 50. The left-right direction in FIG. 3 is the longitudinal direction (the direction in which the cooling air flows), and a parallel duct 52 is provided on both sides in the longitudinal direction, but the structure on both sides is similar (symmetrical about the center axis). In FIG. 3, it is assumed that the cooling air flows from the right side to the left side.

In the boundary surface 51B partitioning the cooling duct 51 and the parallel duct 52, connecting opening portions (opening portions) 51A for connecting the inside of the cooling duct 51 and the inside of the parallel duct 52 are arranged at equal intervals at a plurality of positions (three positions in FIG. 3) along the longitudinal direction. In addition, rectifying plates 511 are provided inside the cooling duct 51 at positions in the longitudinal direction where the connecting opening portions 51A are located. The rectifying plates 511 have a shape such that the air flow from the right side to the left side in the vicinity of the connecting opening portions 51A is directed toward the lower side or directed toward the upper side. In the former case, the rectifying plates 511 are configured to be inclined downward from the upstream side (right side) toward the downstream side (left side) of the flow. In the latter case, the rectifying plates 511 are configured so as to be inclined upward from the upstream side (right side) toward the downstream side (left side) of the flow. In either case, the uppermost portion (the right end portion in the former case, the left end portion in the latter case) of the rectifying plates 511 can be configured so as to connect to the upper surface of the cooling duct 51.

The point that the cooling efficiency of the developing unit 11*a* can be improved by this configuration will be described. As described above, the developing unit 11*a* has an elongated shape, and in the above-described cooling unit 50, cooling is performed by cooling air flowing in the longitudinal direction of the cooling unit 50. Here, in this cooling air, the temperature of the portion on the developing unit 11*a* side (upper side), in particular, becomes high due to heat transfer from the developing unit 11*a*. On the other hand, this effect is small on the lower side, so the temperature on the lower side is low. In the case where the cooling air flows in a state with such a temperature distribution in the vertical direction, the temperature of the cooling air flowing on the developing unit 11*a* side (upper side) rises as the cooling air flows to the downstream side. For this reason, even in the case where the efficiency of cooling by the cooling air is increased on the upstream side, it is generally difficult to increase the cooling efficiency on the downstream side in the case where the cooling air flows along the longitudinal direction as described above.

In this way, in the case where the cooling air that is locally heated on the developing unit 11*a* side flows, in order to increase the cooling efficiency on the downstream side, (1) introducing low-temperature cooling air from the outside on the upper side, or (2) discharging the cooling air which has become a high temperature on the upper side to the outside is effective.

The connecting opening portions 51A and the rectifying plates 511 can be used for this purpose. Here, as described above, the cooling air is steadily supplied to the cooling duct 51, and whether or not the cooling air is similarly allowed to flow in the parallel ducts 52 can be appropriately set. Here, as described above, the parallel ducts 52 do not come in contact with the developing unit 11*a*, so a temperature distribution as described above is not formed in the cooling air flowing therein, and the temperature is uniformly low.

Figure 4A:
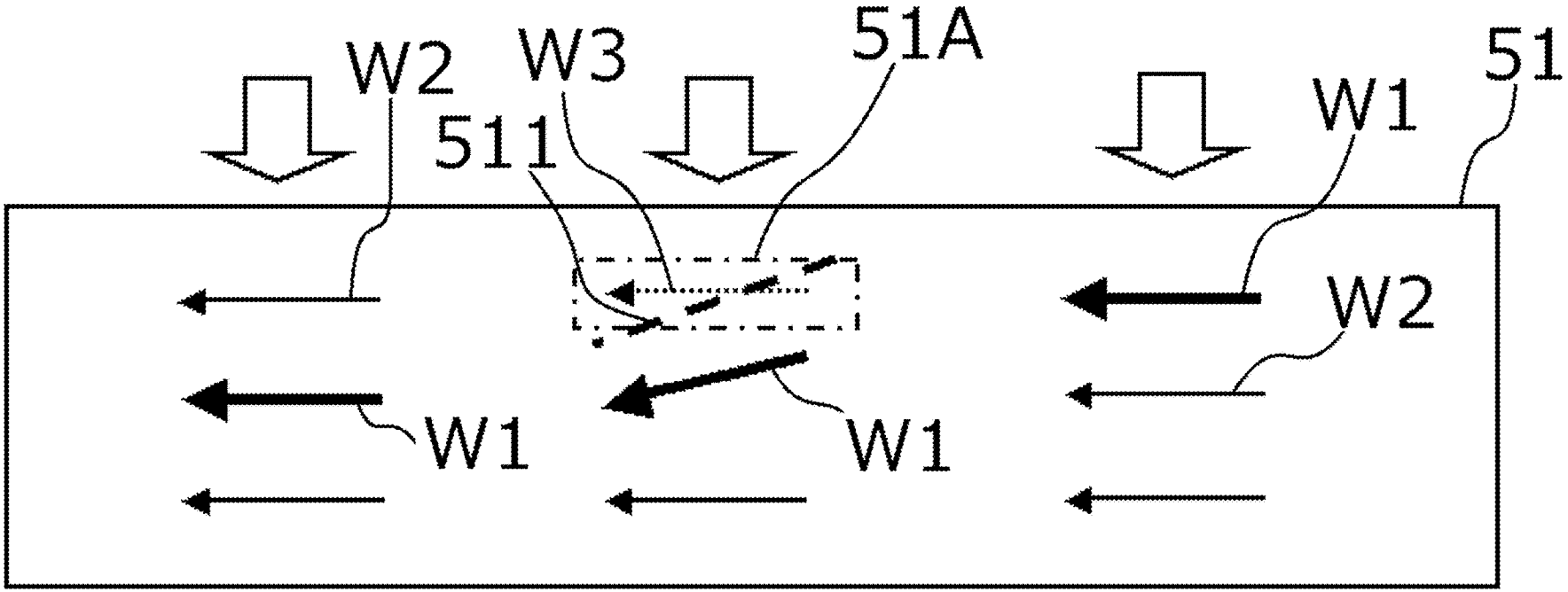
FIG. 4A is a diagram schematically illustrating flow of cooling air in a vertical direction in a first embodiment of a cooling unit used in the image forming apparatus of an embodiment according to the present disclosure.

First, the setting in the case where the cooling air is also made to flow in the parallel ducts 52 will be described. In this case, the rectifying plates 511 are set so as to be inclined downward toward the downstream side (left side). In this case, the flow of the cooling air in the vertical direction in the regions of the cooling duct 51 close to the parallel ducts 52 is schematically illustrated in FIG. 4A in three stages (three rows in the horizontal direction in the fiure) before and after the connecting opening portion 51A. In FIG. 4A, the developing unit 11*a* is provided on the surface on the upper side. In addition, the thick white arrows on the upper side indicate the inflow of heat, the other arrow indicate the flow of the cooling air, and the thickness of the arrows is displayed corresponding to whether the temperature is high or low. The cooling air flows as a whole from the right side (one side) to the left side (the other side) in the drawing.

First, on the upstream side (the rightmost row) from the connecting opening portion 51A, as described above, there is cooling air (high-temperature cooling air W1) that has become a high temperature on the uppermost side, and on the side below that there is cooling air having a low temperature (low-temperature cooling air W2). Here, when this flow in this state as is reaches a position where the connecting opening portion 51A is located, the direction of the high-temperature cooling air W1 is directed downward by the rectifying plate 511. On the other hand, since the low-temperature cooling air is also flowing through the parallel duct 52, as the high-temperature cooling air W1 flows as described above, this low-temperature cooling air (inflow cooling air W3) flows from the parallel duct 52 via the connecting opening portion 51A into the cooling duct 51. Therefore, in a position (the middle row) where the connecting opening portion 51A is located, together with the high-temperature cooling air W1 moving downward, the low-temperature inflow cooling air W3 is introduced to the upper portion.

Therefore, further on the downstream side than the connecting opening portion 51 (the leftmost row), the high-temperature cooling air W1 moves downward to the lower side and low-temperature cooling air W2 is located on the uppermost side. For this reason, it is possible to newly cool the developing unit 11*a* with high efficiency by using this cooling air.

Figure 4B:
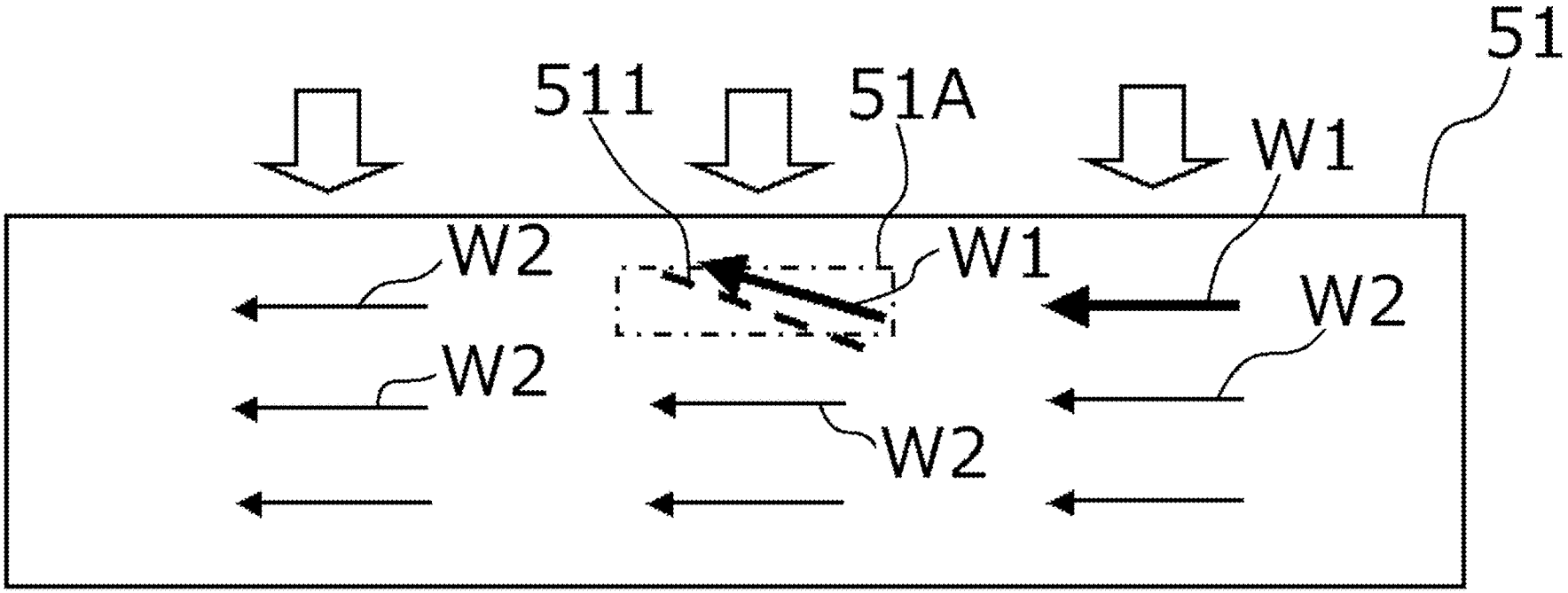
FIG. 4B is a diagram schematically illustrating flow of cooling air in a vertical direction in a second embodiment of a cooling unit used in the image forming apparatus of an embodiment according to the present disclosure.

Next, the setting in the case where the cooling air is not flowing in the parallel duct 52 will be described. In this case, the rectifying plate 511 is set so as to incline upward going toward the downstream side (left side). FIG. 4B illustrates this state in the same way as in FIG. 4A.

The configuration of the cooling air further on the upstream side (the row on the rightmost side) than the connecting opening portion 51A is the same as in the above case. When this flow as is in this state reaches a position where the connecting opening portion 51A is located, the direction of the high-temperature cooling air W1 is directed upward by the rectifying plate 511. However, since there is the upper surface 51C of the cooling duct 51, the high-temperature cooling air W1 in the cooling duct 51 is removed through the connecting opening portion 51A. After that, this high-temperature cooling air W1 is discharged from the outlet of the parallel duct 52.

Therefore, further on the downstream side (the row on the leftmost side) than the connecting opening portion 51A, the high-temperature cooling air W1 is removed and only low-temperature cooling wind W2 is present. For this reason, it is possible to newly cool the developing unit 11*a* with high efficiency by using this cooling air.

In the cases illustrated in both FIG. 4A and FIG. 4B, after cooling the developing unit 11*a* by the flow of cooling air in the state on the most downstream side (row on the leftmost side), the state on the most upstream side (the row on the rightmost side) becomes as illustrated in FIG. 4A and FIG. 4B again. Therefore, it is preferable that a plurality of the connecting opening portions 51A and the rectifying plates 511 be provided, for example, periodically, along the longitudinal direction (flow direction).

Figure 5A:
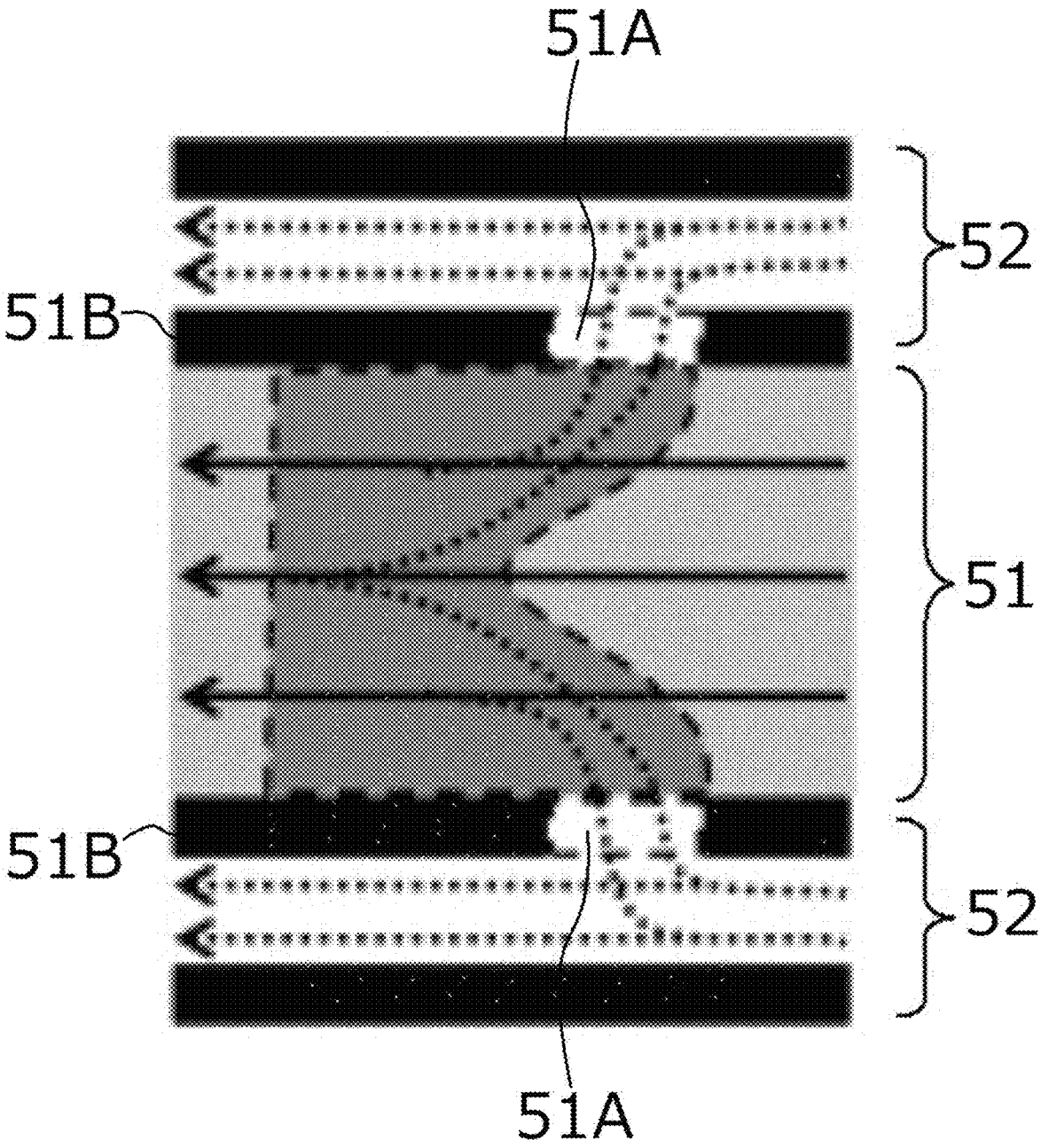
FIG. 5A is a diagram illustrating flow of cooling air in a horizontal direction in a first embodiment of a cooling unit used in the image forming apparatus of an embodiment according to the present disclosure.

FIG. 5A schematically illustrates the flow of the cooling air in the case of FIG. 4A in the horizontal cross section at a location where connecting opening portions 51A in the above-described cooling unit 50 are located. Here, a state is illustrated in which parallel ducts 52 are provided on both sides of the cooling duct 51, and a cross section orthogonal to the states in FIGS. 4A and 4B is illustrated. The color shading corresponds to high temperature or low temperature of the cooling air (air). In this case, the above-described parallel ducts 52 function mainly to newly introduce low-temperature cooling air (inflow cooling air W3) into the cooling duct 51.

Figure 5B:
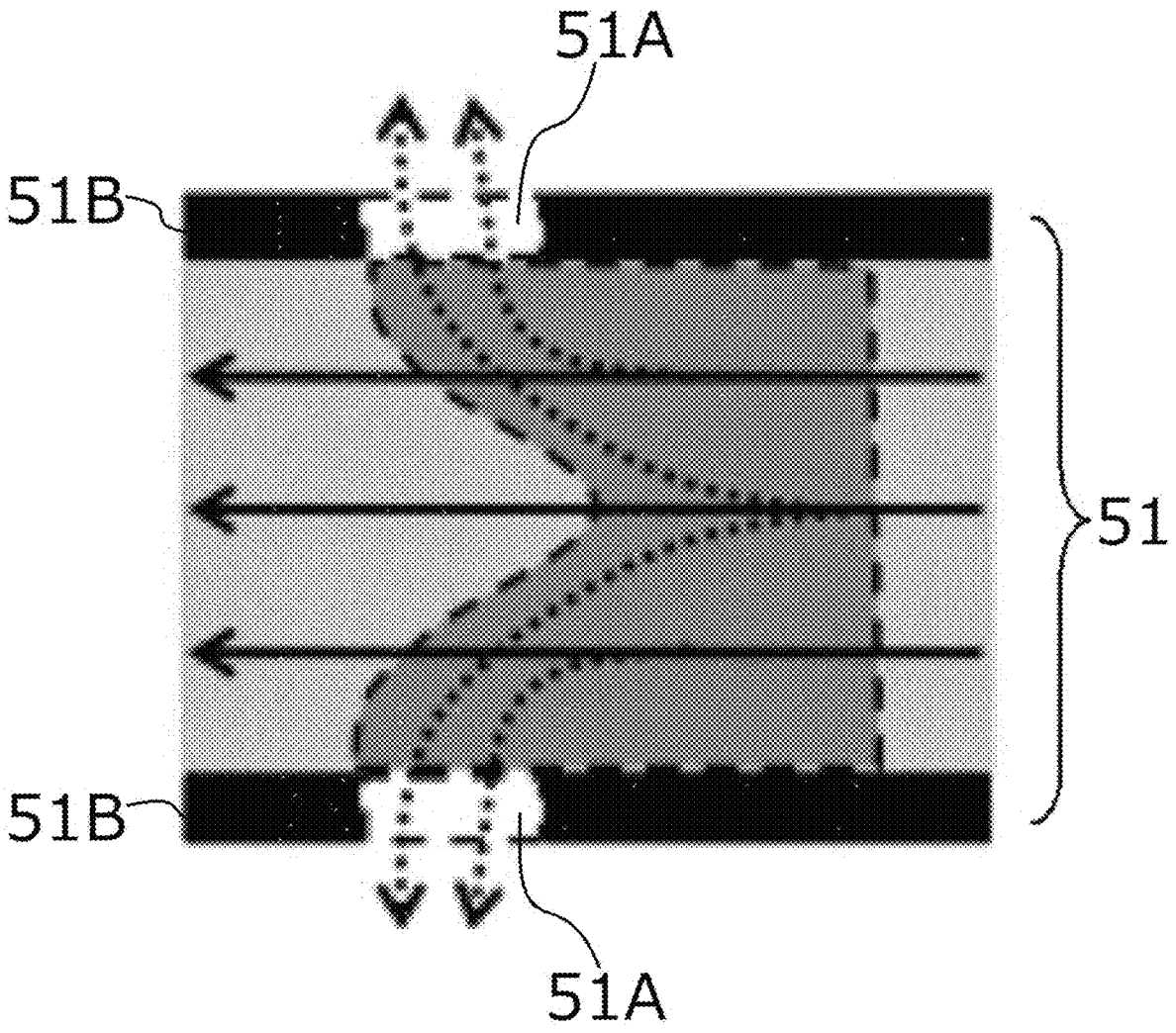
FIG. 5B is a diagram illustrating flow of cooling air in a horizontal direction in a second embodiment of a cooling unit used in the image forming apparatus of an embodiment according to the present disclosure.

FIG. 5B illustrates the flow of cooling air in the case of FIG. 4B in the same manner as in FIG. 5A. In this case, the above-described parallel ducts 52 function mainly to discharge high-temperature cooling air (high-temperature cooling air W1). Therefore, in this case, the same effect can be obtained without the parallel ducts 52. In other words, only the cooling duct 51 may be used, and the structure on the side surface sides thereof may be the above-described structure.

The above-described configuration can be obtained by connecting the parallel ducts 52 to the cooling duct 51 after providing the connecting opening portions 51A and the rectifying plates 51, so the above-described cooling unit 50 has a simple structure. Moreover, in the configuration described above, even in the case where the cooling air is made to flow through the parallel ducts 52, the cooling air flowing through the cooling duct can be branched off and used as this cooling air. Therefore, it is unnecessary to newly add a cooling fan or the like as compared with the case where only the cooling duct is used. Therefore, the cooling unit 50 described above can be obtained at low cost.

Figure 6A:
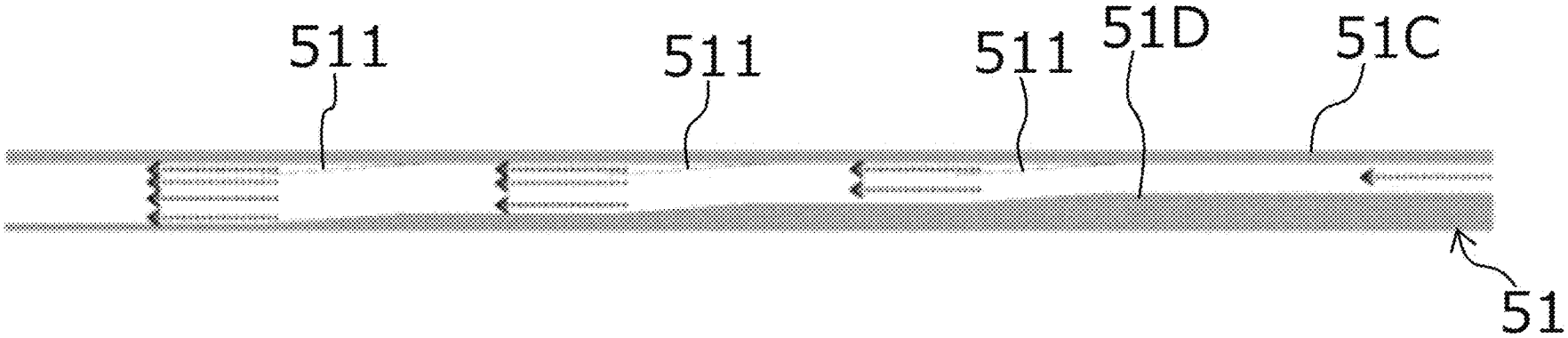
FIG. 6A is a cross-sectional view illustrating flow of cooling air in a horizontal direction in a modified example of a first embodiment of a cooling unit used in the image forming apparatus of an embodiment according to the present disclosure.

Incidentally, as described above, in the case of FIG. 4A and FIG. 5A, in the cooling duct 51, in addition to cooling air originally flowing in the cooling duct 51, the inflow cooling air W3 is newly introduced from the connecting opening portions 51A. Therefore, in order to cause the cooling air to uniformly flow along the longitudinal direction in the cooling duct 51 and uniformly perform cooling, it is preferable that the cross-sectional area along the longitudinal direction inside the cooling duct 51 gradually increase going toward the downstream side. On the other hand, in order to achieve a smooth flow of cooling air as described above, it is particularly preferable to make the interface with the developing unit 11*a* side flat. Therefore, as illustrated in the cross section along the longitudinal direction (flow direction) in FIG. 6A, the upper surface 51C of the cooling duct has a flat shape. On the other hand, it is preferable to make the flow of the cooling air uniform by shaping the height of the lower surface 51D (the surface opposite to the developing unit 11*a*) so as to become lower going toward the downstream side (left side).

Figure 6B:
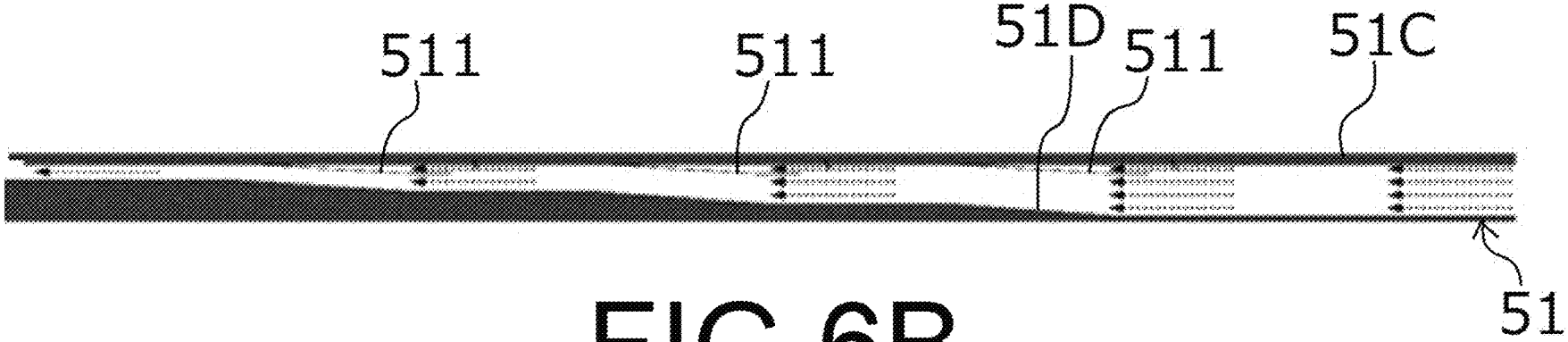
FIG. 6B is a cross-sectional view illustrating flow of cooling air in a horizontal direction in a modified example of a second embodiment of a cooling unit used in the image forming apparatus of an embodiment according to the present disclosure.

However, as described above, in the case illustrated in FIG. 4B and FIG. 5B, in the cooling duct 51, a portion of the cooling air flowing through the cooling duct 51 which has become a high temperature has flows out through the connecting opening portions 51A to the parallel ducts 52. Therefore, in order to cause the cooling air to uniformly flow along the longitudinal direction in the cooling duct 51 and uniformly perform cooling, it is preferable that the cross-sectional area along the longitudinal direction inside the cooling duct 51 become gradually smaller going toward the downstream side. As in the above case, it is preferable that the interface on the developing unit 11*a* side be flat. Therefore, as illustrated in a cross section similar to that in FIG. 6A in FIG. 6B, the upper surface 51C has a flat shape. On the other hand, it is preferable to make the flow of the cooling air uniform by shaping the height of the lower surface 51D (the surface opposite to the developing unit 11*a*) so as to become higher going toward the downstream side (left side).

Figure 7A:
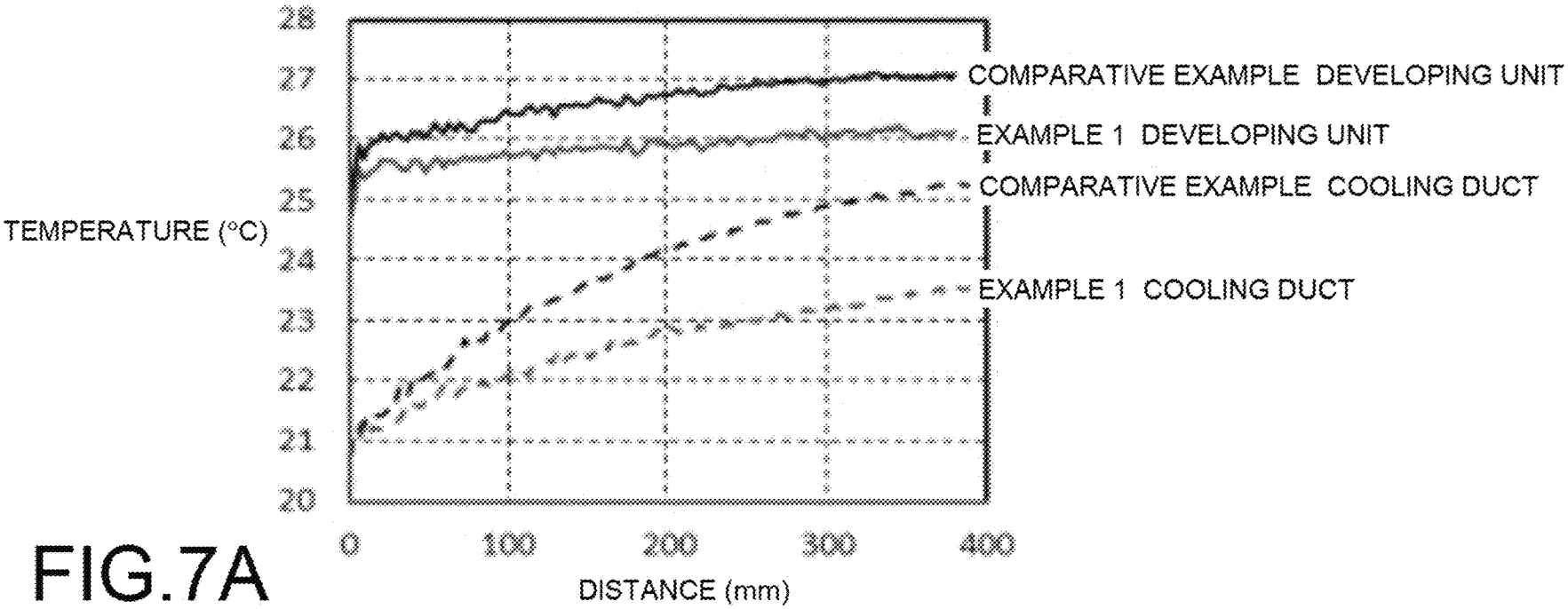
FIG. 7A illustrates results of measuring the temperature distribution of the air inside the developing unit and the cooling duct of an Example 1 and a Comparative Example according to the present disclosure.
Figure 7B:
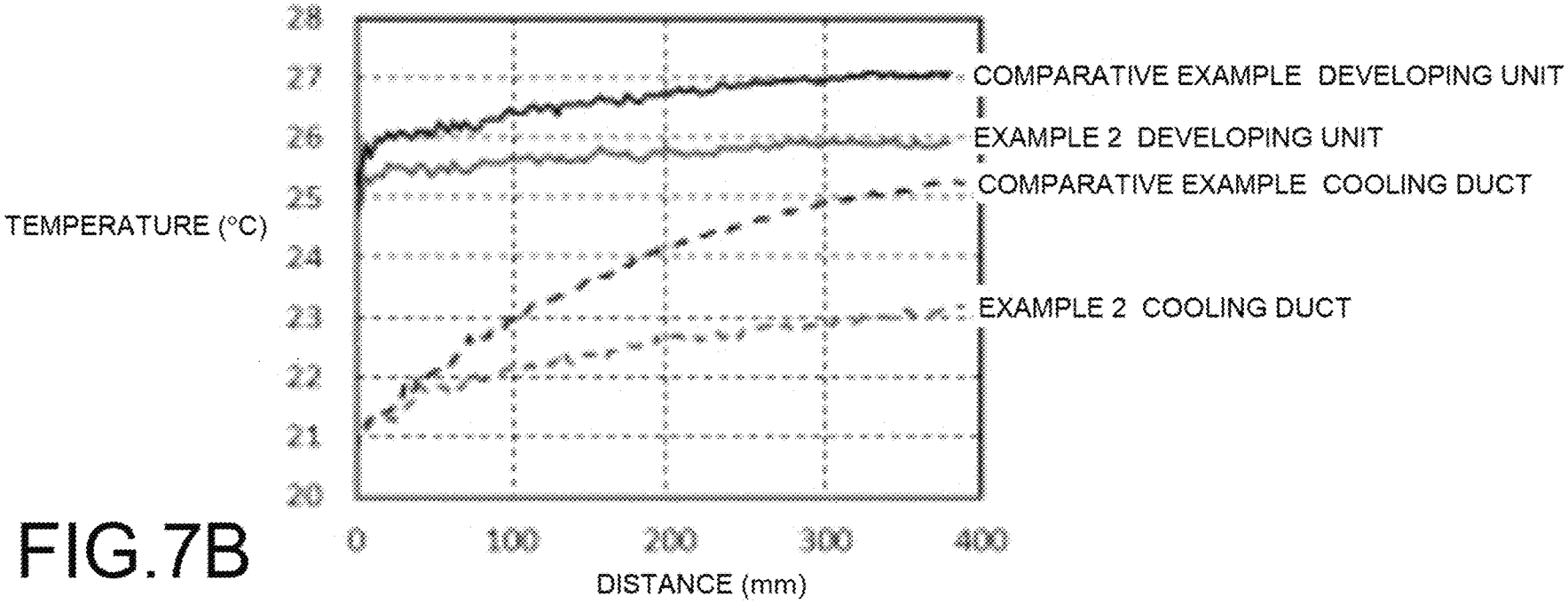
FIG. 7B illustrates results of measuring the temperature distribution of the air inside the developing unit and the cooling duct of an Example 2 and a Comparative Example according to the present disclosure.

Actually, the cooling unit described above was mounted on the developing unit, and the temperature of the air in the cooling duct and the temperature of the developing unit were measured over the longitudinal direction. In an Example 1, the configuration of FIG. 4A is used, and in an Example 2 the configuration of FIG. 4B is used. As a Comparative Example, a cooling unit is used in which only the cooling duct 51 is used, and the parallel ducts 52, the connecting opening portions 51A, and the rectifying plates 511 are not used. In addition, the average value in the vertical direction is measured as the temperature of the air in the cooling duct, and the temperature of the developing unit is measured on the bottom surface. FIG. 7A illustrates the measurement results of Example 1 and the Comparative Example, and FIG. 7B illustrates the measurement results of Example 2 and the Comparative Example. Here, the distance (horizontal axis) is measured from the upstream side of the cooling air.

In any case, the temperature of the developing unit is uniformly higher than the temperature of the air inside the cooling duct due to the heat generation. Moreover, for the reasons described above, the temperature of the developing unit and the air inside the cooling duct both rise going toward the downstream side. However, in both Examples 1 and 2 this temperature rise is suppressed more than in the Comparative Example. Moreover, the temperature of the developing unit in particular is uniformly lowered in Examples 1 and 2, as compared with in the Comparative Example. Therefore, it is confirmed that in Examples 1 and 2 described above, the cooling efficiency is higher than that in the Comparative Example.

In the example described above parallel ducts 52 are provided on both sides of the cooling duct 51. However, as described above, the effect obtained in the case where cooling air is not flowing in the parallel ducts 52 and a part of the cooling air in the cooling duct 51 is made to flow through the parallel ducts 52 is also obtained in the case where the parallel ducts 52 are not provided. It is also obvious that when parallel ducts are not provided and cooling air flows along the left and right outer sides of the cooling duct, the same effect as in the case of cooling air flowing in the parallel ducts 52 as described above can be obtained. Therefore, when the boundary surface 51, the connecting opening portions (opening portions) 51A, and the like are provided similar to as described above, the same effect can be obtained without providing the parallel ducts 52.

In addition, in the example described above, the developing units 11*a* to 11*d* are objects (cooled units) to be cooled by the cooling units 50. However, as in the case of the developing units 11*a* to 11*d*, for cooled units having an elongated shape along one direction and that are cooled by using cooling air flowing along one direction, the above-described cooling units 50 can be similarly used. In this case, by bringing the upper surface of the cooling unit into contact with the cooled unit and by causing the cooling air to flow along one direction, the cooled unit can be cooled with high efficiency. Therefore, this cooling unit can also be used for a cooled unit that is used in various modes. In this case, a relationship such as the vertical relationship described above or the like is a relative relationship in the case where the side of the cooled unit is on the upper side and the cooling unit side is on the lower side, and actually the positional relationship between the cooled unit and the cooling unit is also arbitrary.

In a typical technique, the developing unit is elongated, and in the case where cooling air flows along the longitudinal direction thereof, cooling air (gas air) during cooling is heated by drawing away the heat, so the effect of cooling is large on the upstream side of the flow, however, the cooling efficiency on the downstream side of the flow is low. Therefore, it is difficult to uniformly obtain high cooling efficiency over the longitudinal direction of the developing unit.

For this reason, it is desired to cool the developing unit with high cooling efficiency over the longitudinal direction with a simple structure.

With the above structure, the cooled unit can be cooled with high cooling efficiency in the longitudinal direction with a simple structure.

What is claimed is:

1. An image forming apparatus in which a cooling unit that is mounted on a lower portion of a cooled unit as a cooling target is used to cool the cooled unit by causing cooling air to flow along one direction; wherein the cooling unit comprises a cooling duct having an upper surface that comes in contact with the lower portion of the cooled unit along the one direction, and inside of which the cooling air flows along the one direction from one side toward another side; and the cooling duct is provided with:

an opening portion in a boundary surface that is a surface intersecting a surface contacting the upper surface in the cooling duct, and that connects on the upper surface side an inside portion of the cooling duct with an outside portion of the cooling duct;

a rectifying plate that is located at a location along the one direction where the opening portion is formed, and that deflects the flow of the cooling air on an upper side inside the cooling duct in a vertical direction; and a parallel duct that comes in contact with the cooling duct via the boundary surface and inside of which the cooling air flows along the one direction from the one side toward the another side.

2. The image forming apparatus according to claim 1, wherein opening portions and reflecting plates are provided at a plurality of locations along the one direction in the cooling duct.

3. The image forming apparatus according to claim 1, wherein the cooled unit is a developing unit that uses a developing roller having a rotating axis along the one direction.

4. An image forming apparatus in which a cooling unit that is mounted on a lower portion of a cooled unit as a cooling target is used to cool the cooled unit by causing cooling air to flow along one direction; wherein the cooling unit comprises a cooling duct having an upper surface that comes in contact with the lower portion of the cooled unit along the one direction, and inside of which the cooling air flows along the one direction from one side toward another side;

the cooling duct is provided with:

an opening portion in a boundary surface that is a surface intersecting a surface contacting the upper surface in the cooling duct, and that connects on the upper surface side an inside portion of the cooling duct with an outside portion of the cooling duct; and a rectifying plate that is located at a location along the one direction where the opening portion is formed, and that deflects the flow of the cooling air on an upper side inside the cooling duct in a vertical direction;

in the cooling duct the rectifying plate deflects the flow of the cooling air on an upper side inside the cooling duct upward, and the opening portion is arranged opposite to a direction perpendicular to the one direction and the vertical direction.

5. The image forming apparatus according to claim 4, wherein the cooling duct is configured so that inside thereof, a bottom surface facing the upper surface has a height that becomes higher going toward the another side.

6. The image forming apparatus according to claim 4, wherein in the cooling duct, the opening portion is provided on the boundary surface on both sides so as to face each other in a direction intersecting the one direction.

7. The image forming apparatus according to claim 4, wherein opening portions and reflecting plates are provided at a plurality of locations along the one direction in the cooling duct.

8. The image forming apparatus according to claim 4, wherein the cooled unit is a developing unit that uses a developing roller having a rotating axis along the one direction.

9. An image forming apparatus in which a cooling unit that is mounted on a lower portion of a cooled unit as a cooling target is used to cool the cooled unit by causing cooling air to flow along one direction; wherein the cooling unit comprises a cooling duct having an upper surface that comes in contact with the lower portion of the cooled unit along the one direction, and inside of which the cooling air flows along the one direction from one side toward another side;

the cooling duct is provided with:

an opening portion in a boundary surface that is a surface intersecting a surface contacting the upper surface in the cooling duct, and that connects on the upper surface side an inside portion of the cooling duct with an outside portion of the cooling duct; and a rectifying plate that is located at a location along the one direction where the opening portion is formed, and that deflects the flow of the cooling air on an upper side inside the cooling duct in a vertical direction; and in the cooling duct the rectifying plate deflects the flow of the cooling air on an upper side inside the cooling duct downward.

10. The image forming apparatus according to claim 9, wherein the cooling duct is configured so that inside thereof, a bottom surface facing the upper surface has a height that becomes lower going toward the another side.

11. The image forming apparatus according to claim 9, wherein opening portions and reflecting plates are provided at a plurality of locations along the one direction in the cooling duct.

12. The image forming apparatus according to claim 9, wherein the cooled unit is a developing unit that uses a developing roller having a rotating axis along the one direction.

* * * * *